US006832812B2

(12) United States Patent
Riley et al.

(10) Patent No.: US 6,832,812 B2
(45) Date of Patent: Dec. 21, 2004

(54) SLIPCOVER WRAPPING TECHNIQUE

(75) Inventors: Paula Riley, New York, NY (US); Kenneth V. Stevens, Brooklyn, NY (US)

(73) Assignee: Prescient Partners, L.P., New York, NY (US)

( * ) Notice: Subject to any disclaimer, the term of this patent is extended or adjusted under 35 U.S.C. 154(b) by 0 days.

(21) Appl. No.: 10/770,697

(22) Filed: Feb. 3, 2004

(65) Prior Publication Data

US 2004/0155497 A1 Aug. 12, 2004

Related U.S. Application Data

(62) Division of application No. 10/053,722, filed on Jan. 22, 2002, now Pat. No. 6,709,054.

(51) Int. Cl.[7] ..... A47C 31/00

(52) U.S. Cl. ..... 297/228; 297/218.1; 297/228.11; 24/326

(58) Field of Search ..... 297/228, 227, 297/218.1, 218.2, 228.11, 228.12, 229, 218.4, 225, 224, 219.1

(56) References Cited

U.S. PATENT DOCUMENTS 2,884,993 A * 5/1959 Schutte ..... 297/227
3,116,953 A * 1/1964 Sugarman ..... 297/225
3,195,950 A * 7/1965 Mednick ..... 297/227
3,657,750 A * 4/1972 Staley ..... 5/493
4,838,610 A * 6/1989 Perrin ..... 297/225
5,320,407 A * 6/1994 Tell ..... 297/228.11
5,540,480 A * 7/1996 Christa ..... 297/219.1
5,547,249 A * 8/1996 Riley et al. ..... 297/228.13
5,553,362 A * 9/1996 Stevens ..... 24/326
5,632,068 A * 5/1997 Riley et al. ..... 24/326
5,664,831 A * 9/1997 White et al. ..... 297/225
5,676,422 A * 10/1997 White et al. ..... 297/225
5,722,723 A * 3/1998 Riley et al. ..... 297/228.13
5,733,002 A * 3/1998 Riley et al. ..... 297/224
5,802,681 A * 9/1998 Riley et al. ..... 24/326
6,022,072 A * 2/2000 Moyer ..... 297/182

* cited by examiner

*Primary Examiner*—Peter M. Cuomo
*Assistant Examiner*—Erika Garrett
(74) *Attorney, Agent, or Firm*—Notaro & Michalos PC

(57) ABSTRACT

A slipcover arrangement and method for covering a piece of furniture having a seat and a back, includes a fabric, semi-fitted slipcover body for covering the furniture, the slipcover body having a side portion for covering a side of the furniture and a front portion for covering a front of the furniture. The body includes a seat portion connected to the side and front portions for covering the seat of the furniture and a back portion connected to the seat and side portions for covering the back of the furniture and with excess fabric for extending into a crevice between the seat and back of the furniture. The front and side portions are connected to each other with excess fabric for a corner of the furniture between the front and side of the furniture. The excess fabric for the corner of the furniture is twisted into an elongated wrap portion for lying flat against the furniture and a wrap retaining band having opposite ends permanently connected to the slipcover body, extends over the wrap portion for pressing the wrap portion against the furniture.

16 Claims, 9 Drawing Sheets

SLIPCOVER WRAPPING TECHNIQUE

CROSS REFERENCE TO RELATED APPLICATION

This is a divisional of application Ser. No. 10/053,722 filed Jan. 22, 2002 and now U.S. Pat. No. 6,709,054.

FIELD AND BACKGROUND OF THE INVENTION

The present invention relates in general to slipcovers for seating furniture having one or more arms, and in particular a new and useful method and apparatus for covering such furniture which includes a strategic gathering and holding of corners of the semi-fitted fabric cover so that the cover conforms well to the furniture.

Although unfitted covers are cheap and can be used for more types and sizes of furniture, it is difficult to make them look neat and hold their position on the furniture. Typically, an unstructured or unfitted furniture cover, that is, a large, flat, fabric rectangle, is draped over a sofa and hand-tucked around the seating perimeter. The fabric, now formed to the cushion area, runs over the arms and front and up and over the back of the sofa, hanging loosely in folds or bunches. Next, the cover makers suggest that excess fabric spilling onto the floor be tucked under the sofa. Then an elasticized skirt is placed around the base of the sofa as a means of containing the untidy outer folds with a finishing touch. For a more regular, tailored look, the makers recommend the use of screw pins to hold particular pleats and folds in place. Screw pins are also suggested as a means of holding the skirt to the cover and also for anchoring the whole assembly to the sofa upholstery itself. As a final measure, the makers suggest strategically hand-tacking the cover and skirt with needle and thread.

U.S. Pat. No. 1,825,909 discloses the use of elastic cords connected to various portions of a furniture slip-cover, for structuring the cover closely around furniture such as an armchair or sofa. U.S. Pat. No. 1,857,418 discloses initially unstitched seams in a partially structured furniture cover which, to achieve a final fit, are stitched after the cover is fitted onto the furniture.

U.S. Pat. No. 2,884,993 discloses the use of bands and fasteners for fitting a slip cover to a chair or sofa. U.S. Pat. No. 5,320,407 discloses the use of tubes which are stitched in the portions of a slipcover which will eventually cover inner or outer corner areas of the furniture, and pull cords in the stitched tubes. After covering the sofa or chair, the cords are pulled to gather the cover at the corner areas, thus producing shirring effect.

None of these references suggest any method or apparatus which is capable of converting an unstructured furniture cover, such as a simple rectangular sheet of fabric, into a cover which conforms closely to the furniture.

U.S. Pat. No. 5,553,362 invented by one of the co-inventors of the present application, discloses an apparatus and method for fitting an unstructured fabric furniture cover to a piece of furniture which includes an elongated triangular wrapping member. Excess fabric at the corner areas of the piece of furniture is wrapped around the triangular member and fitted to the corner area of the furniture. A clip or band is used to hold the wrapped excess fabric against the corner area for fitting the unstructured fabric cover to the piece of furniture.

The use of unfitted, semi-fitted and fully fitted fabric furniture covers on sofas, love seats and chairs has grown markedly over the past years. Various slipcovers and slipcover accessory products have been developed by the assignee of the present application to address some of the problems associated with this type of furniture cover. See, for example, the present co-inventors' U.S. Pat. Nos. 5,802,681; 5,733,002; 5,722,723; 5,664,832; 5,632,068 and 5,547,249.

Among the problems associated with these types of slipcovers are loose, messy fit; disheveled appearance; and erratic pleating at the arms.

One proposed solution is to heavily elasticize most of the seams of a semi-fitted slipcover as disclosed in U.S. Pat. No. 5,664,831. This, however, leaves a stretched bag-like appearance over the entire piece of furniture, rather than a smooth tailored look that could previously be achieved only by using a custom fit and therefor expensive slipcover which is unique for each piece of furniture.

Elastic skirts are also disclosed in U.S. Pat. No. 5,676,422 for holding an unfitted cover to a reclining chair. Here again, it is difficult to achieve a smooth finished look, and impossible to maintain the look after the furniture has been used.

Another approach for gathering in the excess fabric in fitted but not custom covers is disclosed in U.S. Pat. No. 5,549,355.

The following patents disclose various concepts for covering furniture having arms: U.S. Pat. No. 2,667,211; U.S. Pat. No. 2,671,499; U.S. Pat. No. 2,800,169; U.S. Pat. No. 2,820,510; U.S. Pat. No. 2,921,625; and U.S. Pat. No. 3,116,953.

The present invention is intended to provide an improved slipcover arrangement and slipcover method which has additional control over the placement and maintenance of a semi-fitted cover on seating furniture with one or more arms, including sofas, love seats and armchairs, and on such furniture which has both rectangular cushions and T-shaped cushions. T-shaped cushions are commonly referred to as "T-cushions" and are particularly difficult to fit with semi-fitted slipcovers. The invention can also be used on furniture with no arms. In all cases the invention accumulated the excess fabric in such a way that the end result is a well contoured cover that fully follows the shape and structure of the furniture rather than approximating its shape in a loose and misfit manner as in most of the prior art.

SUMMARY OF THE INVENTION

It is an object of the present invention to provide a semi-fitted slipcover arrangement and method for covering seating furniture such as armchairs, love seats and sofas having at least one arm or no arms, and whether the furniture has one or more T-cushions or non-T-cushions or no cushions at all.

Accordingly, an object of the invention is to provide a slipcover arrangement for covering a piece of furniture having a seat and a back, the arrangement comprising: a semi-fitted fabric slipcover body for covering the furniture, the slipcover body having a back portion for covering the back if the furniture, a seat portion forming an L-shape with the back portion for covering the seat of the furniture, a side portion with a hem edge for extending horizontally near a lower end of a side of the furniture when the furniture is covered by the slipcover body and, for furniture with at least one arm, an arm portion for covering the arm; at least part of the arm portion, or a part near a front corner of the seat portion when there is no arm, being twisted in either direction into an elongated wrap portion for lying flat against the arm, front or side of the furniture; wrap retaining means connected to the slipcover body for extending over the wrap portion and for pressing the wrap portion against the furniture; an elastic band connected to the slipcover body and extending along the side portion substantially parallel to the hem edge for holding the side portion against the side of the furniture; and a cover skirt connected to the slipcover body and extending over the wrap retaining means to decoratively cover the elastic wrap retaining means.

An other object of the invention is to provide a method for covering a piece of furniture having a seat, a back and at least one arm, or no arms, the method comprising the steps of: providing a fabric slipcover body for covering the furniture, the slipcover body having a side portion with a hem edge for extending horizontally near a lower end of a side of the furniture when the furniture is covered by the slipcover body and an arm portion for covering the arm when the furniture has an arm; twisting at least part of the arm portion or part of the slipcover near a front corner of the cover if there is no arm, into an elongated wrap portion for lying flat against the furniture; retaining the wrap portion against the furniture at a retaining area below the arm of the furniture; elastically holding the slipcover body side portion against the side of the furniture; and covering the retaining area with a cover skirt connected to the slipcover body to decoratively cover the retaining area.

According to another feature of the invention, the cover skirt has opposite ends. Either end may be fixed, e.g. by sewing, to the slipcover body, with the opposite end being detachably connected to the slipcover body, e.g. by hook-and-loop fastening tapes. Alternatively, both ends of the cover skirt may be detachably connected to the slipcover body, e.g. by hook-and-loop fastening tapes.

According to a still further feature of the invention for use with T-cushion furniture, the retaining means holds the wrap portion against the side of the arm. For furniture with cushions that are not T-cushions, the retaining means holds the wrap portion against the front of the furniture arm.

The invention is further enhanced by inserting a flat, tapered wrap member, e.g. a triangular member, under loose, excess parts of the arm portion after the slipcover body has been draped over the furniture, and twisting the excess material to form a neat, taught wrap portion. A wrap or wrapping member similar to that shown in U.S. Pat. No. 5,553,362 is ideal for this purpose.

According to another feature of the invention, stabilizing members or devices such as the grips having V-shaped cross-sections as disclosed in U.S. Pat. No. 5,547,249, or the grips of U.S. Pat. No. 5,722,723 can be used over a seat covering portion of the slipcover and in the side and back seat crevices to securely hold the seat covering portion of the slipcover on the seat of the furniture.

The wrap technique can also be used at the rear corners of the furniture. Alternatively, elastic seams are used at the front and/or rear corners of the furniture rather than the wraps and the resulting shirred accumulation of fabric is covered by the cover skirt at the front corners for a finished look.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
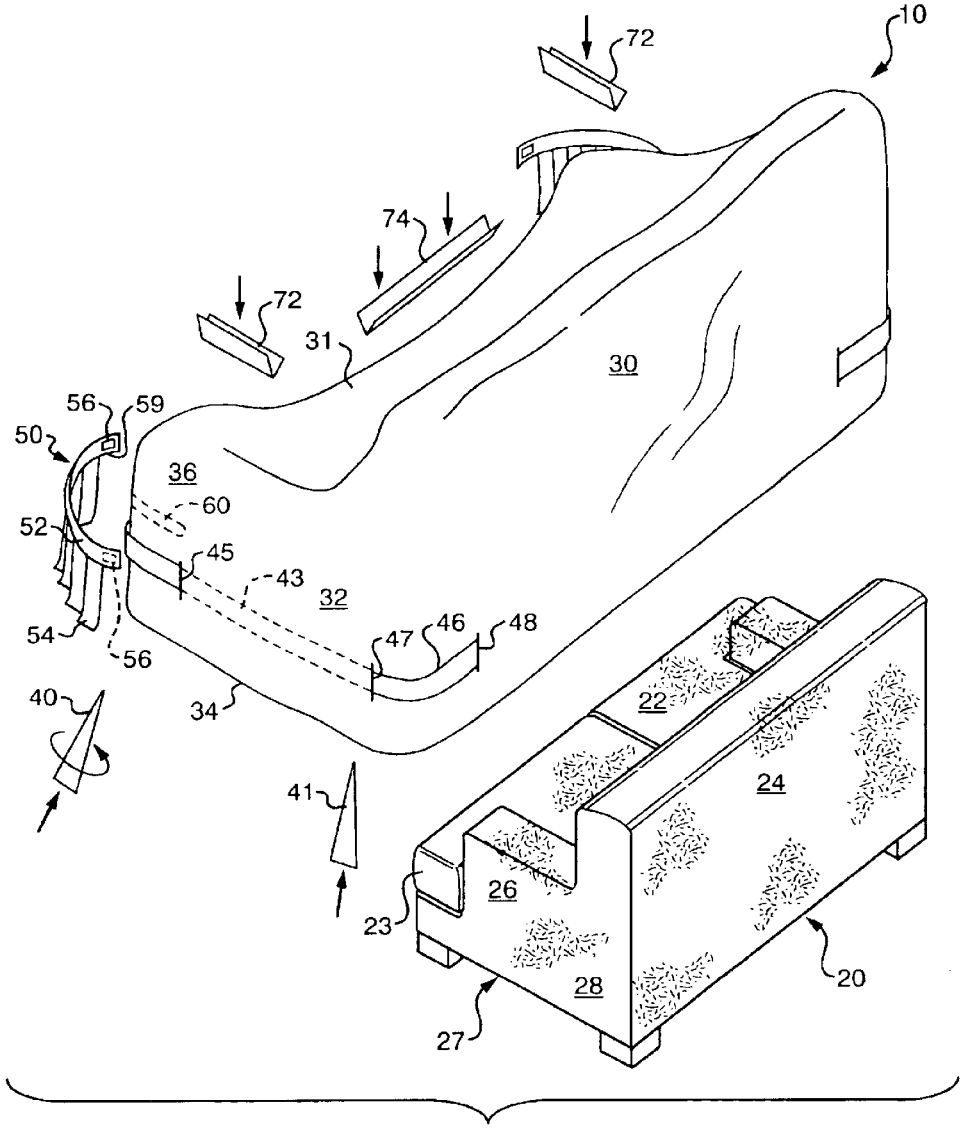
FIG. 1 is an exploded, perspective view of the slipcover arrangement and method of the invention before it is draped onto a piece of furniture having T-cushion.

Referring now to the drawings, in which like reference numerals are used to refer to the same or similar elements, FIG. 1 illustrates a slipcover arrangement 10 for covering a piece of furniture 20 having a seat 22, a back 24 and at least one arm 26.

Figure 2:
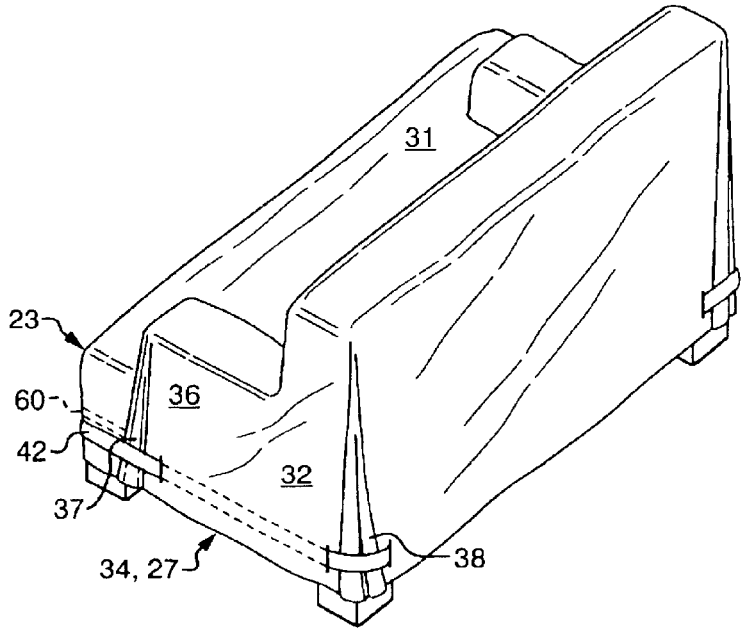
FIG. 2 is a perspective view of the embodiment of FIG. 1 after a slipcover body of the invention has been draped onto the furniture and wrap portions have been twisted to accumulate excess fabric at the arms, and optionally at the rear corners of the furniture, and the wrap portion has been captured under an elastic retaining means of the invention.

The arrangement 10 comprising a fabric slipcover body 30 for covering the furniture 20, made of any known or yet undiscovered, woven or non-woven fabric that is appropriate for slipcovers. The slipcover body 30 has a side portion 32 with a hem edge 34 for extending horizontally near a lower end 27 of a side 28 of the furniture 20, when the furniture is covered by the slipcover body as shown in FIG. 2. Slipcover body 30 also has an arm portion 36 with excess, loose fabric so that any shape or size of furniture arm 26 can be covered.

To accumulate and neatly store this excess fabric, at least part of the fabric arm portion is twisted into an elongated triangular wrap portion 37 shown in FIG. 2. This can best be done by using a tapered, flat, triangular wrap member 40 which, after the slipcover body is carefully draped over the furniture, is slipped under a front or side part of the fabric arm portion and then carefully twisted in the direction of the curved arrow in FIG. 1, that is away from the center of the furniture piece, as the fabric is carefully pulled and smoothed over the furniture arm 26, the T-cushion corner 23 and the furniture side 28.

The invention will also operated correctly if the wrap portion is made by twisting in the opposite direction to curved arrow in FIG. 1.

An elastic band 42, having spaced apart opposite ends sewn to the slipcover body 30 and extending around an area of the body which will cover a lower, front, side corner of the furniture, extends over the wrap portion 37 for holding the wrap portion flat against the side of the arm 26 of the furniture piece 20. In practice the wrap portion is twisted into shape first and then the wrap portion is slipped under the band 42 which thus forms elastic wrap retaining means connected to the slipcover body for extending over the wrap portion and for pressing the wrap portion against the arm of the furniture.

Another elastic band 43, or an extension of the same band 42, is also connected to the slipcover body, e.g. at the opening 45 of a tunnel extending inside and along the side portion 32, substantially parallel to the hem edge 34. This additional band accumulates and holds the side portion 32 against the side 28 of the furniture 20 and helps pull the back portion of the slipcover body, across the back 24 of the furniture 20.

A still further elastic band 46, or a further extension of elastic bands 42 and 43, emerges from an opposite tunnel opening 47 and extends around a lower, rear, side corner of the furniture 20 when the slipcover body is in place, to capture and hold a rear wrap portion 38 against the furniture near the rear corner area of the furniture. Although a similar wrap member 41 can be used to help twist and form the rear wrap portion 38, as with front warp portion 37, it can be made without the wrap member.

At the rear corners of the furniture 20, each band 46 may be left exposed or be covered by a decorative fabric tube that matches the fabric of slipcover body 30. This is because the rear corner areas of furniture 20 are usually not very visible. At the front, lower corner areas of the furniture, however, the elastic retaining band 42 must be covered to conceal it and its retaining function. To this end the arrangement of the invention includes a cover skirt 50 connected to the slipcover body and extending over the elastic wrap retaining means to decoratively cover it. Cover skirt 50 has an upper ribbon portion 52 with ends that extend beyond a pleated, downwardly hanging skirt portion 54 of the cover skirt. Either end is sewn to the slipcover body and the opposite end can be removably attached to the slipcover body, e.g. using look-and-loop tapes 56 such as those sold under the trademark VELCRO. Alternatively, both ends of the cover skirt may be detachably connected to the slipcover body, e.g. by hook-and-loop fastening tapes.

In this way, after the wrap portion 37 is formed and captured under elastic band 42, the cover skirt 50 is smoothed over the elastic band and fastened at the front, or side, or both the front and side, of the slipcover body to cover the wrap retaining means.

The side end 58 of skirt ribbon 52 can be concealed further by extending it into the tunnel opening 45 and providing the appropriate fasteners inside the tunnel. Alternatively the end 58 is sewn inside the tunnel and the opposite end 59 is detachably attached to the slipcover body.

Figure 3:
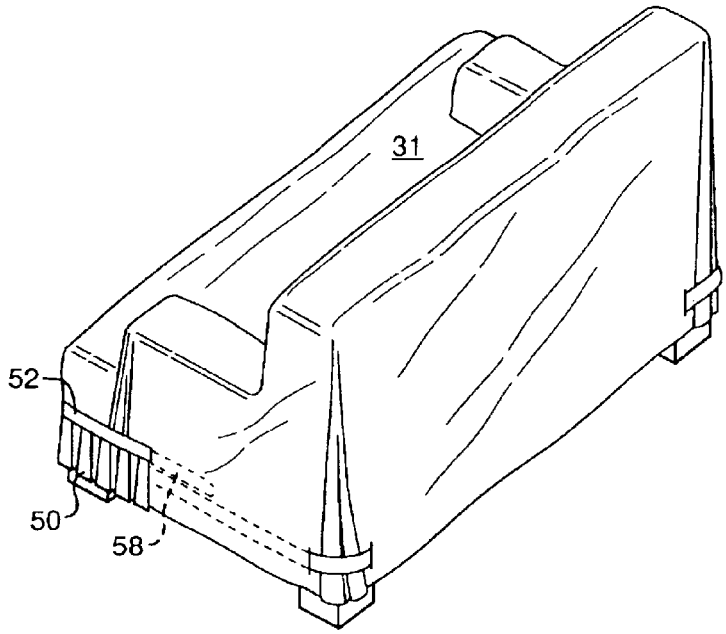
FIG. 3 is a view similar to FIG. 2 but after a cover skirt has been applied over the retaining means to decoratively cover the retaining means.
Figure 4:
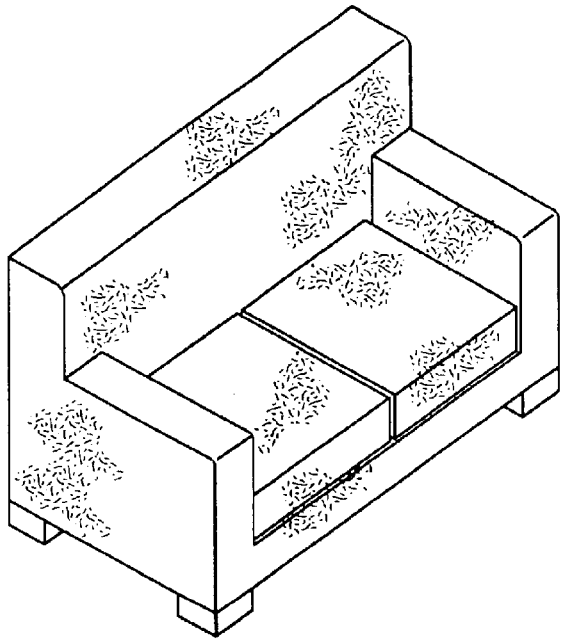
FIG. 4 is front side perspective view of another piece of furniture with cushions that are not T-cushion, but which can be covered by the arrangement and method of the invention.
Figure 5:
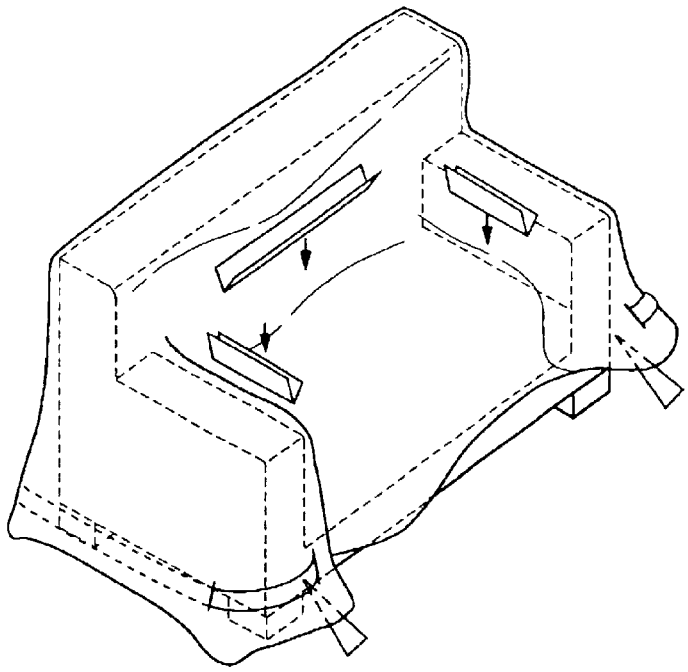
FIG. 5 is a view similar to FIG. 4 of the slipcover body of the invention after it is initially draped onto the furniture.
Figure 6:
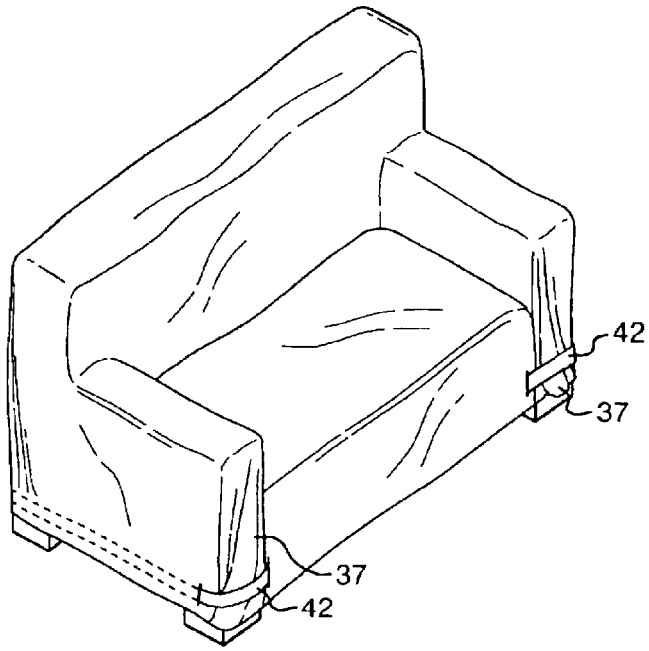
FIG. 6 is a view similar to FIG. 5 of the slipcover body of the invention after its wrap portions have been formed and captured.
Figure 7:
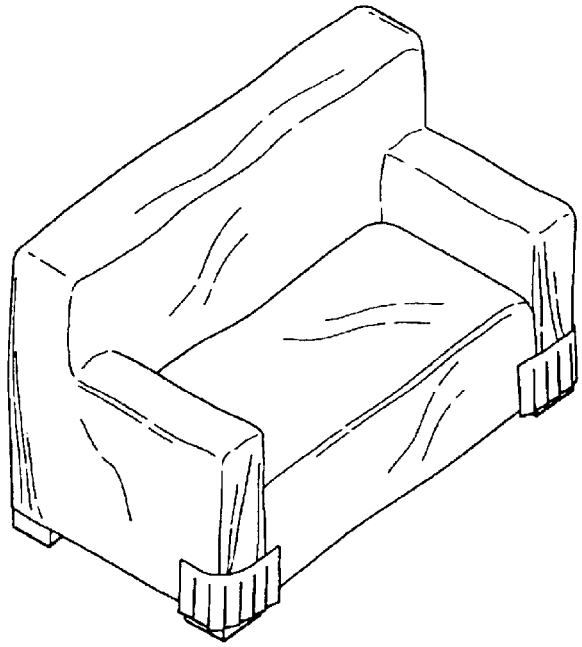
FIG. 7 is a view similar to FIG. 6 of the slipcover body of the invention after a cover skirt has been applied to cover the retaining means over the wrap portion.

For the embodiments of FIGS. 1 to 3, a T-cushion piece of furniture is covered and the retaining means 42 holds the wrap portion against the side of the arm 26. For furniture with cushions that are not T-cushions as illustrated in FIGS. 4 to 7, the retaining means holds the wrap portion against the front of the furniture arm. Since the wrap portion 37 extends straight down from the top of the arm to the bottom of the furniture front, no further treatment is required for the slipcover body.

To smoothly and firmly hold the slipcover body to furniture with T-cushions, however, a further elastic cord or band 60 is sewn into a further tunnel at the corner areas of the slipcover body, at a location which will ultimately be near a front corner of the T-cushion. This additional piece of elastic acts to closely embrace the T-cushion corner in front of the arm.

The method of the invention thus provides a fabric slipcover body for covering the furniture, the slipcover body having a side portion with a hem edge for extending horizontally near a lower end of a side of the furniture when the furniture is covered by the slipcover body and an arm portion for covering the arm; twists at least part of the arm portion into an elongated wrap portion for lying flat against the arm of the furniture; elastically retains the wrap portion against the arm of the furniture at a retaining area below the arm of the furniture; elastically holds the slipcover body side portion against the side of the furniture; and covers the retaining area with a cover skirt connected to the slipcover body to decoratively cover the retaining area.

The invention is further enhanced by inserting the flat, tapered wrap member, e.g. triangular member 40, under loose, excess parts of the arm portion after the slipcover body has been draped over the furniture, and twisting the excess material to form a neat, taut wrap portion. As noted, the wrap or wrapping member is similar to that shown in U.S. Pat. No. 5,553,362 is ideal for this purpose.

The invention is even further enhanced by using stabilizing devices 72 and 74 such as the grips having V-shaped cross-sections as disclosed in U.S. Pat. No. 5,547,249, or the grips of U.S. Pat. No. 5,722,723, used in the side and back seat crevices around the tops of the seat cushions, to securely hold the seat covering portion 31 of the slipcover over the seat 22 of the furniture 20.

Figure 8:
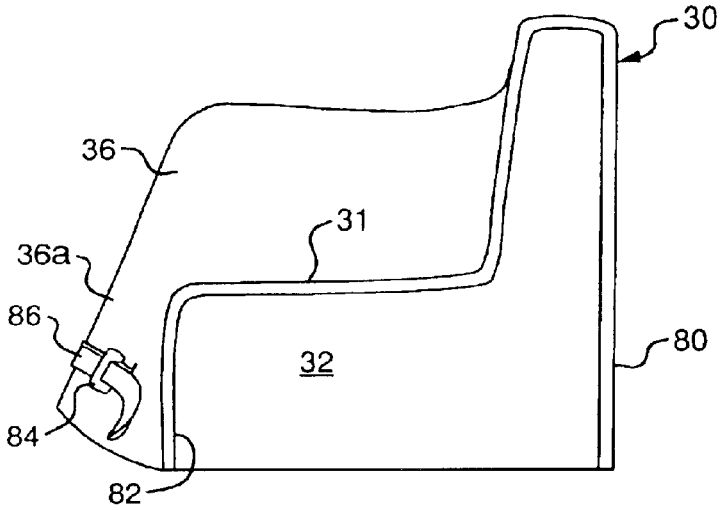
FIG. 8 is a sectional view through the central part of the semi-fitted slipcover of the invention and with a different embodiment of the retaining means.

FIG. 8 is a sectional view which illustrates the nature of the semi-fitted slipcover of the invention and an alternative retaining means in the form of a non-elastic belt 86 with a buckle 84. The belt 86, may, for example, be made of two parts, each sewn or otherwise attached at spaced locations across the bottom, front of the arm portion 36 of the slipcover body 30. The free ends of the belt portions are brought together at the buckle 84 and, after the wrap portion is formed and slipped under the belt, the one or both belt ends are pulled through the buckle to fix the wrap portion in place.

As seen in FIG. 8, the semi-fitted fabric slip-cover body 30 has a back portion 80 that extends from the rear bottom edge of the furniture, up and over the back of the furniture to the crease between the front surface of the furniture back and the cushions or seat of the furniture. The slipcover body also has a seat portion 31 that extends from the back portion 80 to a front skirt portion 82 that extends from the top, front edge of the furniture seat or cushions, to the bottom front edge of the furniture.

Figure 9:
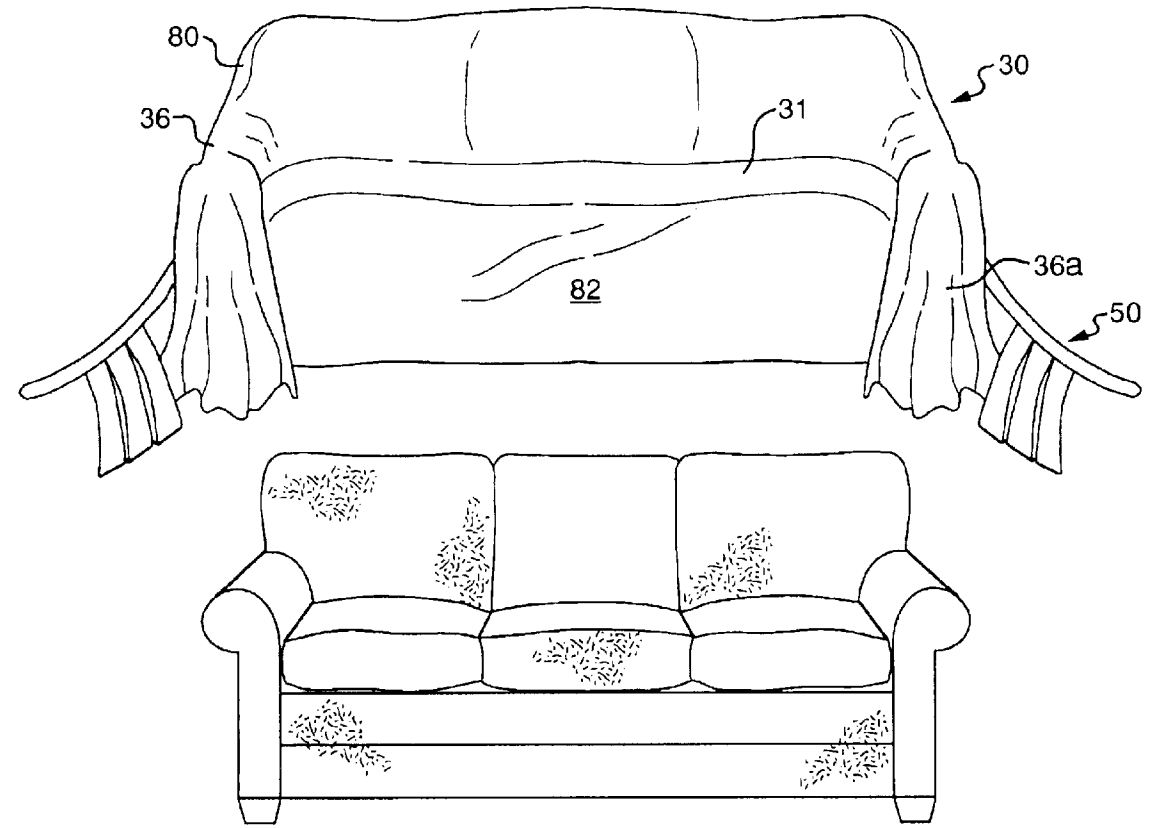
FIG. 9 is an exploded front elevational view of the invention used on a sofa with differently shaped arms.

Although the back, seat and skirt portions 80, 31 and 82, form a generally L-shaped mid-portion for the semi-fitted slipcover body 30, that is cut large enough to fit the back and seat of the largest piece of furniture to be covered, the arm portion 36, attached at one or both ends of the mid-portion, is cut with a generous arcuate front portion 36*a* that must be large enough to cover all parts of a furniture arm. See, for example, FIG. 9, which shows another piece of furniture with a roll arm that can also be closely covered by the present invention. The excess fabric of the over size arm portion 36, is effectively wrapped up in the wrap portion 37 and neatly held in place by the retaining means.

The side portion 32 is connected, e.g. via sewing, to the sides of the back, seat and skirt portions 80, 31 and 82, and to the arm portion 36. All other seams between the various pieces of fabric that form the slipcover body may also be made via sewing or any other conventional or yet unknow manner of connecting fabric parts. The term "fabric" is also used here to include not only woven or non-woven sheets made of treads of fibers, but any other sheet material that can be used to cover furniture such as plastic or other synthetic sheets.

Figure 10:
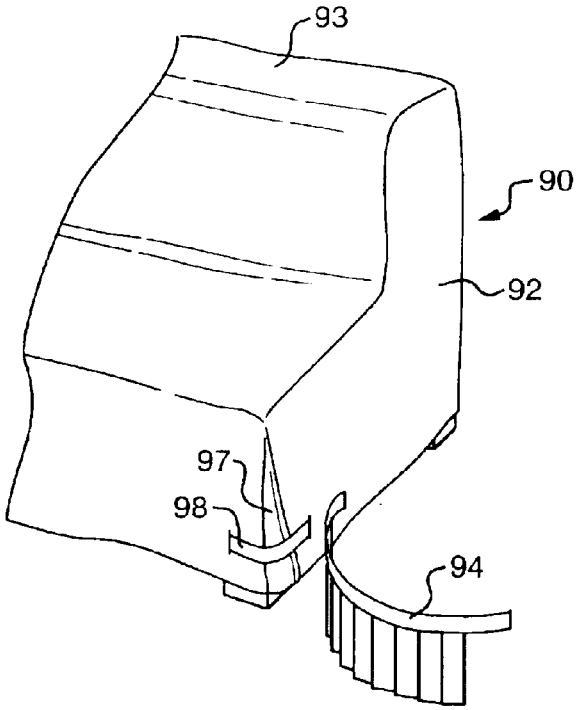
FIG. 10 is a partial perspective view of another embodiment of the invention for covering an arm-less, or the arm-less end of a piece of furniture according to the invention.

FIG. 10 illustrates another possible embodiment of the invention for covering an arm-less or the arm-less end of a piece of furniture, where the semi-fitted slipcover 90, has an L-shaped mid-portion 93 that includes a back, a seat and a skirt portion, and a side portion 92 with excess fabric at the corner between the side of the furniture and the skirt. The excess fabric is accumulated in a wrap portion 97, held by an elastic or a non-elastic retaining band 98 and decoratively covered be a corner cover skirt 94 as in the other embodiments of the invention.

In another embodiment of the invention the semi-fitted slipcover has no excess fabric to be accumulated in a wrap portion, but used other elastic of non-elastic means to pull the slipcover against the front corner of the furniture. The corner area is still, however, covered by the cover skirt portion 94 and can be used with furniture that has one or more arm, and with arm-less furniture.

The use of one or more wrap portions, however, in conjunction with an elastic or non-extendible retaining means in the semi-fitted and therefore highly versatile slipcover technique of the present invention, replaces the sewn seams of a custom, single use slipcover without sacrificing the smooth custom look which could formerly only be achieved with custom fit slipcovers. Since even custom fit slipcovers must be made a little larger than the specific piece of furniture they are designed to cover, even custom slipcovers may occasionally look less than smooth and taught. The wrapping technique of the invention, however, provides the added versatility of being able to tighten up all critical areas of the slipcover and provide an even smoother and tighter cover than expensive custom fit covers in some cases.

Figure 11:
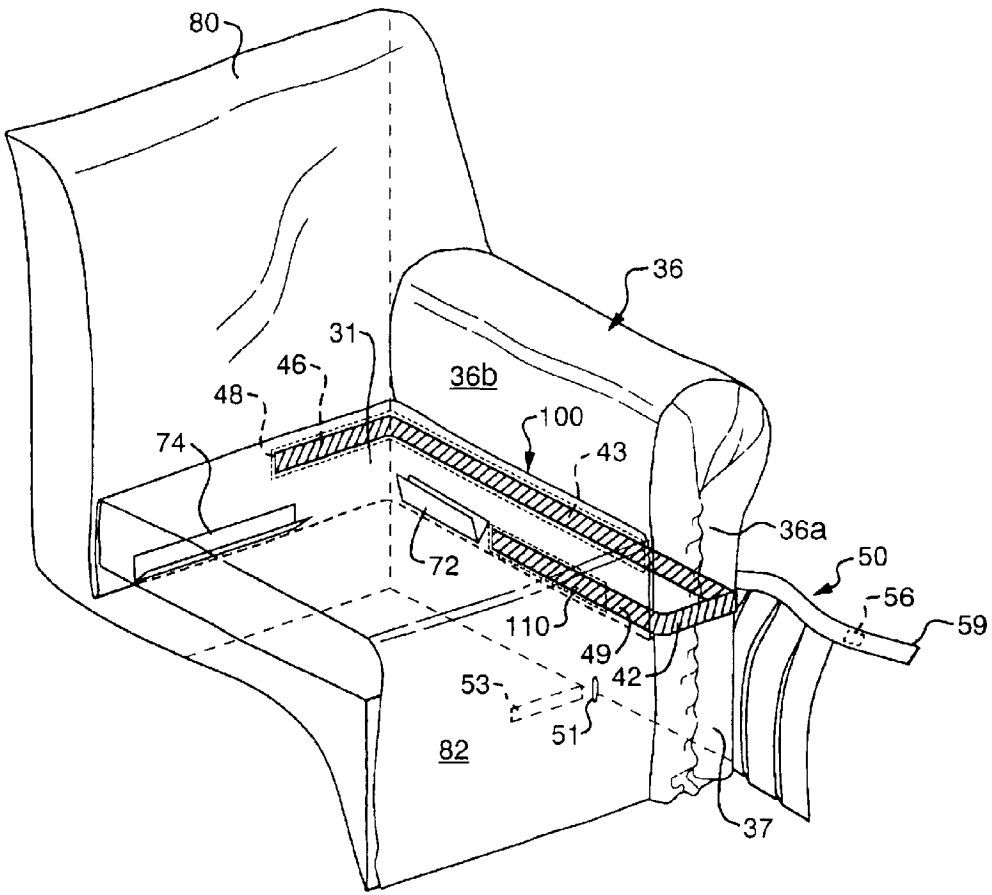
FIG. 11 is a partial perspective view of a covered piece of furniture according to the invention, showing additional structural features of the slipcover.
Figure 12:
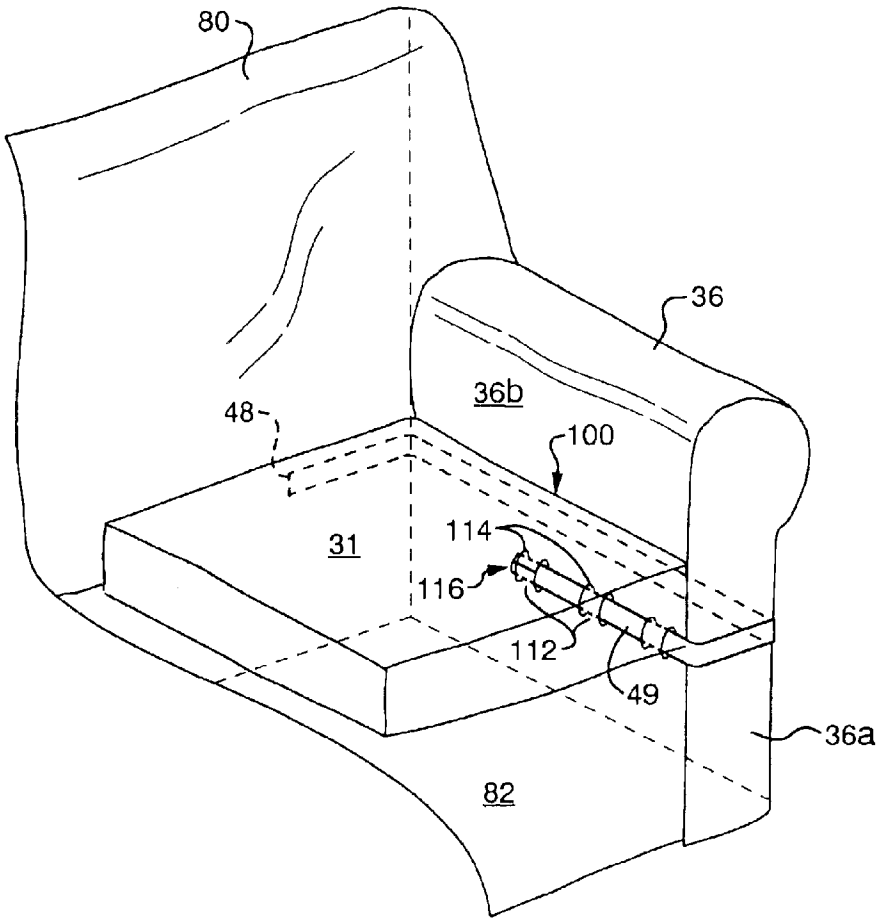
FIG. 12 is a view similar to FIG. 11 of another embodiment of these additional features.
Figure 13:
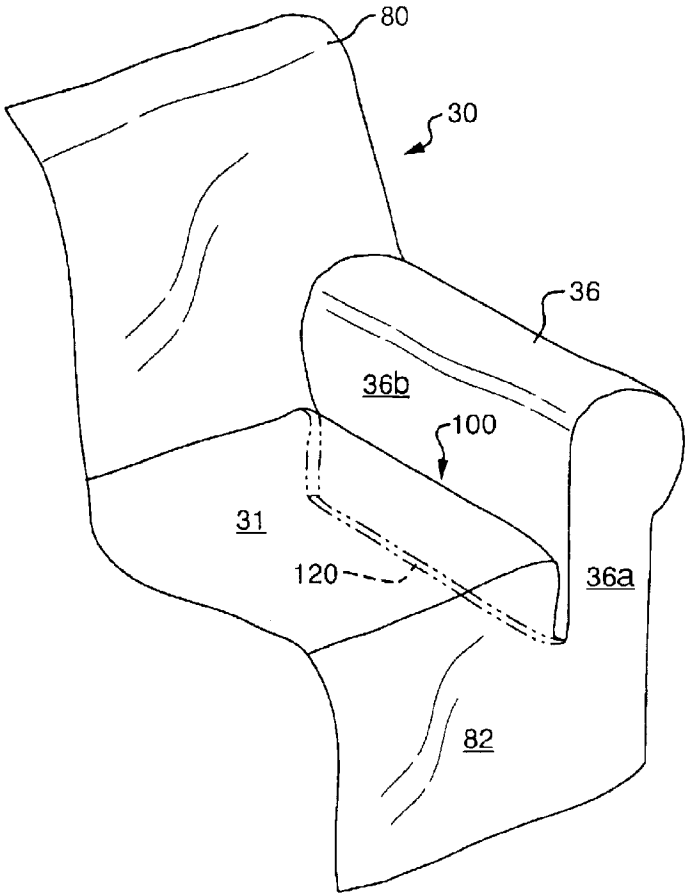
FIG. 13 is a view similar to FIG. 11 of a still further embodiment of these additional features.

Referring to FIGS. 11 to 13, another feature of the present invention which has been found advantageous is the presence of elastic gather means generally designated 100, provided between the seat portion 31 and an inside surface portion 36*b* of the arm portion 36 of the slipcover body 30. The seat portion 31 is cut generously so as to allow for some of its fabric to be pressed down into the crevice between the furniture seat and the furniture back, and to be pressed down into the crevice between the furniture seat and the furniture arm or arms. This excess fabric is fixed in place by the grips 74 and 72. See FIGS. 1 and 11, for example. The inventors have found that additional elastic gathering is useful in this crevice area between the slipcover seat portion 31 and the arm portion 36, or specifically the inside surface portion 36*b* of the arm portion, to help further gather the front portion 36*a* of the arm portion, in addition to the wrap portion at the front of the arm, and to help smooth and fix the seat and inside surface portions 31 and 36*b*.

To this end, and as illustrated in FIG. 11, the elastic gather means 100 comprises an elastic band 49 that extends in a further tunnel or path 110 defined in or on the slipcover body between the seat and inside surface portions 31,36*b*. This elastic member or band 49 may be an extension of retaining band 42 and side band 42, or it may be an additional elastic band or member. The end of band 49 deepest in the crevice (that is closest to the furniture back and slipcover back portion 80) can be sewn or otherwise fixed to the fabric of the slipcover body 30. FIG. 11 also illustrates the presents of a front skirt 82, sewn or otherwise fixed to the front of seat portion 31, and extending between the seat front portions 36*a*, or from the front portion 36*a* if the slipcover is for furniture having only one arm.

In FIG. 12, the gather means 100 is shown with the rest of the slipcover simplified. FIG. 12 better illustrated the elastic path that start from the rear of the back portion 80, e.g. at starting seam 48, and extended around the rear corner and side of the slipcover, around the from of the arm and over the front portion 36*a* (that is destined to be wrapped in wrap portion 37) and into the seat/arm crevice. In the embodiment of FIG. 12, the path is formed by a plurality of slits 114 that form loops 112 through which the elastic member 49 extends and is anchored at termination 116 via sewing or other attachment means.

FIG. 13 illustrates another embodiment of the gather means 100 which is created by weaving or inserting an elastic member 120 into an intermittently sewn seam in the crevice and between the seat portion 31 and the inside surface portion 36*b*.

The inside end of the elastic member or band 49 may also not be fixed to the slipcover at 116 in FIG. 11, but may be left loose. The side grip 72 in the seat-to-arm crevice can then be used as the only mechanism for fixing this end of the band. The grip can also be used to hold and fix the free end 59 of cover skirt 50 in the crevice. As another alternative way of fixing this end of cover skirt 50, the ribbon like end 59 is shortened and has a hook/loop tap 56 sewn or otherwise fixed to its outside surface. Ribbon end 59 can then be passes into a button-hole slit 51 in the skirt portion 82 near the arm, and attached to a longer, mating hook/loop tape 53, sewn or otherwise attached to the inside surface of skirt portion 82. The length of tape 53 provides adjustability for fixing the end 59 so that various arm shapes and sizes can be accommodated.

While specific embodiments of the invention have been shown and described in detail to illustrate the application of the principles of the invention, it will be understood that the invention may be embodied otherwise without departing from such principles.

What is claimed is:

1. A slipcover arrangement for covering a piece of furniture having at least a seat and a back, the arrangement comprising:

a fabric, semi-fitted slipcover body for covering the furniture, the slipcover body having a side portion for covering a side of the furniture, a front portion for covering a front of the furniture, a seat portion connected to the side and front portions for covering the seat of the furniture, and a back portion connected to the seat and side portions for covering the back of the furniture and with excess fabric for extending into a crevice between the seat and back of the furniture, the front and side portions being connected to each other with excess fabric for a corner of the furniture between the front and side of the furniture;

the excess fabric for the corner of the furniture being twisted into an elongated wrap portion for lying flat against the furniture; and a wrap retaining band having opposite spaced apart ends that are each permanently connected to the slipcover body at locations spaced from the corner of the furniture, the wrap retaining band extending over the wrap portion for pressing the wrap portion against the furniture.

2. The arrangement of claim 1, wherein the wrap retaining band an elastic band.

3. The arrangement of claim 1, including a cover skirt connected to the slipcover body and extending over the wrap retaining band to decoratively cover the band.

4. The arrangement of claim 3, wherein the cover skirt has opposite ends, the arrangement including means for fixed each of the opposite ends of the cover skirt to the slipcover body.

5. The arrangement of claim 4, wherein at least one of the means for fixing comprises hook-and-loop fastening tapes.

6. The arrangement of claim 1, wherein the furniture has a T-cushion.

7. The arrangement of claim 1, wherein the furniture has no T-cushion.

8. The arrangement of claim 1, including a flat, tapered wrap member twisted into the wrap portion.

9. The arrangement of claim 1, including at least one stabilizing member for engagement into the crevice of the furniture to securely hold the slipcover body on the seat of the furniture.

10. The arrangement of claim 1, wherein the wrap retaining band is elastic band and the arrangement includes an elongated band extending from the elastic band and into a tunnel of the slipcover.

11. The arrangement of claim 1, wherein the wrap retaining band is an elongated non-elastic retaining belt.

12. The arrangement of claim 1, wherein the slipcover body has an L-shaped mid-portion forming the front, seat and back portions.

13. A method for covering a piece of furniture having at least a seat and a back, the method comprising the steps of:

providing a fabric, semi-fitted slipcover body for covering the furniture, the slipcover body having a side portion for covering a side of the furniture, a front portion for covering a front of the furniture, a seat portion connected to the side and front portions for covering the seat of the furniture, and a back portion connected to the seat and side portions for covering the back of the furniture and with excess fabric for extending into a crevice between the seat and back of the furniture, the front and side portions being connected to each other with excess fabric for a corner of the furniture between the front and side of the furniture;

twisting the excess fabric for the corner of the furniture into an elongated wrap portion for lying flat against the furniture; and retaining the wrap portion against the furniture using a wrap retaining band having opposite spaced apart ends that are each permanently connected to the slipcover body at locations spaced from the corner of the furniture, the wrap retaining band extending over the wrap portion for pressing the wrap portion against the furniture.

14. The method of claims 13, including covering the wrap retaining band with a cover skirt connected to the slipcover body to decoratively cover the band.

15. The method of claim 13, including twisting a flat, tapered wrap member into the wrap portion before it is retained against the furniture.

16. The method of claim 13, including inserting a stabilizing member into the crevice of the furniture to securely hold the slipcover body on the seat of the furniture.

* * * * *